US005314131A

United States Patent [19]

McCanless et al.

[11] Patent Number: 5,314,131

[45] Date of Patent: May 24, 1994

[54] APPARATUS FOR DISPENSING ROLLED FLEXIBLE SHEET MATERIAL

[75] Inventors: Forrest S. McCanless, Oxford; Bruce T. Boone, Acworth, both of Ga.

[73] Assignee: Georgia-Pacific Corporation, Atlanta, Ga.

[21] Appl. No.: 113

[22] Filed: Jan. 4, 1993

[51] Int. Cl.[5] ..... B65H 16/02

[52] U.S. Cl. ..... 242/55.3; 242/55.53; 242/55.54

[58] Field of Search ..... 242/55.3, 55.42, 55.53, 242/55.54

[56] References Cited

U.S. PATENT DOCUMENTS

| | | | |
|---|---|---|---|
| 1,917,641 | 7/1933 | Fairchild . | |
| 2,510,537 | 6/1950 | Agamaite, Jr. | 242/55.3 |
| 3,101,181 | 8/1963 | Clelland et al. | 242/55.3 |
| 3,284,014 | 11/1966 | Wiggins et al. | 242/55.53 |
| 3,295,777 | 1/1967 | Carroll | 242/55.3 |
| 3,295,900 | 1/1967 | Kendall | 242/55.3 |
| 3,438,589 | 4/1969 | Jespersen | 242/55.2 |
| 3,484,052 | 12/1969 | Clarke | 242/55.42 |
| 3,584,802 | 6/1971 | Sleber | 242/55.3 |
| 3,586,252 | 6/1971 | Sutten | 242/55.3 |
| 4,025,004 | 5/1977 | Massey | 242/55.3 |
| 4,662,577 | 5/1987 | Lewis | 242/55.3 |

FOREIGN PATENT DOCUMENTS

| | | | |
|---|---|---|---|
| 623434 | 7/1961 | Canada | 242/55.53 |
| 2077700 | 12/1981 | United Kingdom | 242/55.53 |

*Primary Examiner*—Joseph J. Hail, III
*Assistant Examiner*—John P. Darling
*Attorney, Agent, or Firm*—Banner, Birch, McKie & Beckett

[57] ABSTRACT

A dispenser for dispensing sheet material from a roll has a storage section wherein at least one reserve roll can be stored on a storage mandrel until depletion of a supply roll positioned on a dispensing mandrel in a dispensing section. Upon depletion of the supply roll, the user may pivot and remove the roll core from the dispensing mandrel. Upon return of the dispensing mandrel to its dispensing position, under a spring bias, the dispensing mandrel displaces and thereby releases a spring arm holding the reserve roll in the storage position against the bias of a spring urging the reserve roll toward the dispensing section. Upon release, the spring pushes the reserve roll onto the dispensing mandrel for dispensing. The dispenser housing has an inner frame member slidable within an outer frame member between a nested position wherein respective ends of the storage and dispensing mandrel are adjacent each other and dispensing and roll transfer can occur, and a protruded position wherein space is provided between respective ends of the storage and dispensing mandrels to allow reloading of the storage and dispensing sections.

37 Claims, 9 Drawing Sheets

APPARATUS FOR DISPENSING ROLLED FLEXIBLE SHEET MATERIAL

BACKGROUND OF THE INVENTION

The present invention relates to the storage and dispensing of rolled flexible sheet material. More specifically, the invention relates to an improved toilet tissue dispenser which can store, transfer, and dispense a plurality of toilet tissue rolls in a simple and effective manner regardless of its mounted orientation.

Institutional toilet tissue dispensers are frequently sized and adapted to hold and dispense multiple rolls of toilet tissue. This is desirable to reduce maintenance costs and the possibility that a user may be left without toilet tissue. Existing multiple roll tissue dispensers can basically be classified into four groups.

A first group of multiple roll tissue dispensers expose concurrently two supply rolls to the user for dispensing. A problem with these dispensers is that typically both rolls will be depleted at a similar rate. This is a problem because it forces maintenance workers to replace partially used rolls in order to avoid a situation where a user is left without tissue. This increases waste and supply costs. Alternatively, if the maintenance worker elects not to replace the rolls until the rolls are depleted, the aforementioned problem of placing the user in a position of being without toilet tissue arises. Another disadvantage of dispensers concurrently exposing multiple rolls is that the exposure of the rolls to the environment makes them more susceptible to damage and vandalism.

Multiple tissue dispensers of a second group orient two horizontal rolls side-by-side and include a horizontal sliding cover which alternately covers one roll while exposing the other. Simple free sliding cover designs do protect the storage roll while a primary roll is being used, and serve to encourage depletion of one roll before the other. However, concurrent roll depletion may still occur so that the shortcomings of the first group are not eliminated.

An improved design incorporates a mechanism which requires the supply roll to be completely exhausted and the core torn off before the cover is allowed to be moved to expose the reserve roll. While this improved design eliminates the problem of concurrent roll depletion, it requires that the user perform a sequence of non-intuitive operations: tearing off the core and sliding the cover.

A third group consists of dispensers which protect a reserve roll until the supply roll is depleted and then automatically initiate an action to transfer the reserve roll into the dispensing position. U.S. Pat. No. 1,917,641 issued to Fairchild provides a double roll dispenser which accommodates two horizontal paper rolls coaxially upon a single mandrel. Upon depletion of the supply roll beyond a certain amount, a plate spring biased against an end surface of the reserve roll automatically ejects the depleted supply roll through an aperture in an end gate of the dispenser as the reserve roll is pushed into the dispensing position. This design eliminates the problem of concurrent roll depletion, but gives rise to other problems. With this type of dispenser the depleted core is ejected without warning and could startle the user. Also, this type of automatic ejection typically leads to clutter on the floor, as it is unlikely users will make an effort to find and pick up a core which has been ejected from the dispenser. Furthermore, a problem arises in that the spring biased plate is always pushing the rolls toward the end gate. This creates friction between the supply roll and the end gate, between the two rolls, and between the reserve roll and the spring. This friction could inhibit adversely the rotation of the supply roll when there is a reserve roll on the mandrel.

Another type of automatic ejection system of the third group is disclosed in U.S. Pat. No. 3,438,589 issued to Jespersen. This type of system supports paper rolls by trunnions located within the roll core. However, this system requires split core rolls which are not compatible with standard tissue dispensers.

Dispensers in a fourth group hold in a protected position a reserve roll until the user initiates an action to transfer the reserve roll into a dispensing position. There are three basic variations within this group, as described below.

Horizontal rolls stacked vertically is a dispenser configuration within the fourth group. These dispensers stack two or more rolls vertically with the rotational axes of the rolls extending horizontally, and drop the reserve roll or rolls from a concealed and protected storage position in the top of the dispenser into a dispensing position below. These manual dispensers usually require the user to push the exhausted supply roll backward or downward. A deficiency of these designs is that they do not force complete exhaustion of the supply roll.

Another configuration within this fourth group is horizontal rolls mounted side-by-side. Two such designs are disclosed in U.S. Pat. No. 2,510,237, issued to Agamite, Jr. and U.S. Pat. No. 3,584,802, issued to Sieber. In U.S. Pat. No. 2,510,237, the user is required to first tear the core of the exhausted supply roll off the mandrel and then manually move the reserve roll to a dispensing position by pushing it with his or her finger inserted through a recess in the outer casing. One disadvantage of this design is that the step of tearing the core off of the mandrel is not intuitive, nor always easy to accomplish. In U.S. Pat. No. 3,584,802, the expended core is ejected out an aperture in the sidewall of the dispenser upon the sliding of a handle or button by the user to transfer a reserve roll to a dispensing position. Because the roll transfer requires the user to slide a handle or a button, this design is more difficult to use and is less sanitary than an automatic transfer device.

A third dispenser configuration within the fourth group stacks a plurality of rolls vertically with the rotation axes of the rolls also extending vertically, and protects a reserve roll until the user initiates an action to permit the reserve roll to fall into the dispensing position by gravity. Two such designs are disclosed in U.S. Pat. No. 3,295,777, issued to Carroll and U.S. Pat. No. 3,484,052, issued to Clarke. A disadvantage of this type of dispenser is that users, being accustomed to the usual horizontal orientation of the dispensing roll, often dislike vertically oriented rolls. In addition, since these dispensers are gravity operated, they must be mounted vertically. This results in a tall and one-position only dispenser that can be difficult to mount conveniently, e.g., in a handicap-bar equipped restroom stall.

SUMMARY OF THE PRESENT INVENTION

In view of the foregoing, it is a principal object of the present invention to provide an improved multi-roll dispenser for dispensing flexible sheet material rolls, e.g., toilet tissue.

More specifically, it is an object of the invention to provide a multi-roll dispenser which minimizes paper waste and the possibility that a user would be left without toilet tissue.

Another object is to allow transfer of a reserve roll to a dispensing position by the user while forcing the user to exhaust a supply roll before accessing the reserve roll.

It is yet another object of the invention to provide a dispenser that allows a depleted supply roll to be replaced with a reserve roll by a simple operation that will be intuitive to most users.

A still further object of the invention is to provide a dispenser which does not require a difficult separate step of ripping the core of an exhausted supply roll in order to replace the supply roll.

Another object of the invention is to provide a multi-roll dispenser in which a reserve roll may be transferred to a dispensing position in a non-alarming manner, and without cluttering a surrounding area with expelled roll cores.

Still another object is to protect the reserve roll from damage and vandalism.

An additional object of the invention is to provide a dispenser which has mounting flexibility, whereby the dispenser can be installed in any orientation, e.g. horizontal, inverted horizontal, or vertical.

These and other objects are achieved by the present invention which, according to one aspect, provides a dispenser for dispensing multiple rolls of flexible sheet material having a housing which defines a storage section and a dispensing section. The dispenser includes a storage mandrel for receiving and supporting a reserve roll of sheet material within the storage section, and a dispensing mandrel for receiving and supporting a supply roll of sheet material within the dispensing section. The dispensing mandrel is movable between a first position for dispensing material therefrom, and a second position for removing a depleted roll therefrom. The dispenser also includes transfer means for automatically transferring a reserve roll from a reserve position on the storage mandrel to a dispensing position on the dispensing mandrel, in response to the dispensing mandrel being moved into the first position after the withdrawal of a depleted roll core.

In a second aspect, the invention provides a dispenser for storing and dispensing multiple rolls of flexible sheet material having a housing which includes inter-engaging inner and outer frame members. The housing defines storage and dispensing sections. The dispenser includes a storage mandrel attached at one end to a sidewall of either the inner or outer frame members for receiving and supporting a roll of sheet material within the storage section, and a dispensing mandrel attached at one end to a sidewall of the frame member not used for mounting the storage mandrel, for receiving and supporting a roll of sheet material within the dispensing section. The dispenser also includes a transfer mechanism for transferring a reserve roll of sheet material from a position on the storage mandrel to a position on the dispensing mandrel. Additionally, the inner frame member is movable relative to the outer frame member from a first position where respective ends of the storage and dispensing mandrels are adjacent one another to permit operation of the transfer mechanism, and a second position where respective end portions are spaced from each other to permit replacement rolls to be loaded onto the mandrels.

These and other objects and features of the invention will be apparent upon consideration of the following detailed description of preferred embodiments thereof, presented in connection with the following drawings in which like reference numerals identify like elements throughout.

DETAILED DESCRIPTION OF THE PREFERRED EMBODIMENTS

Figure 1:
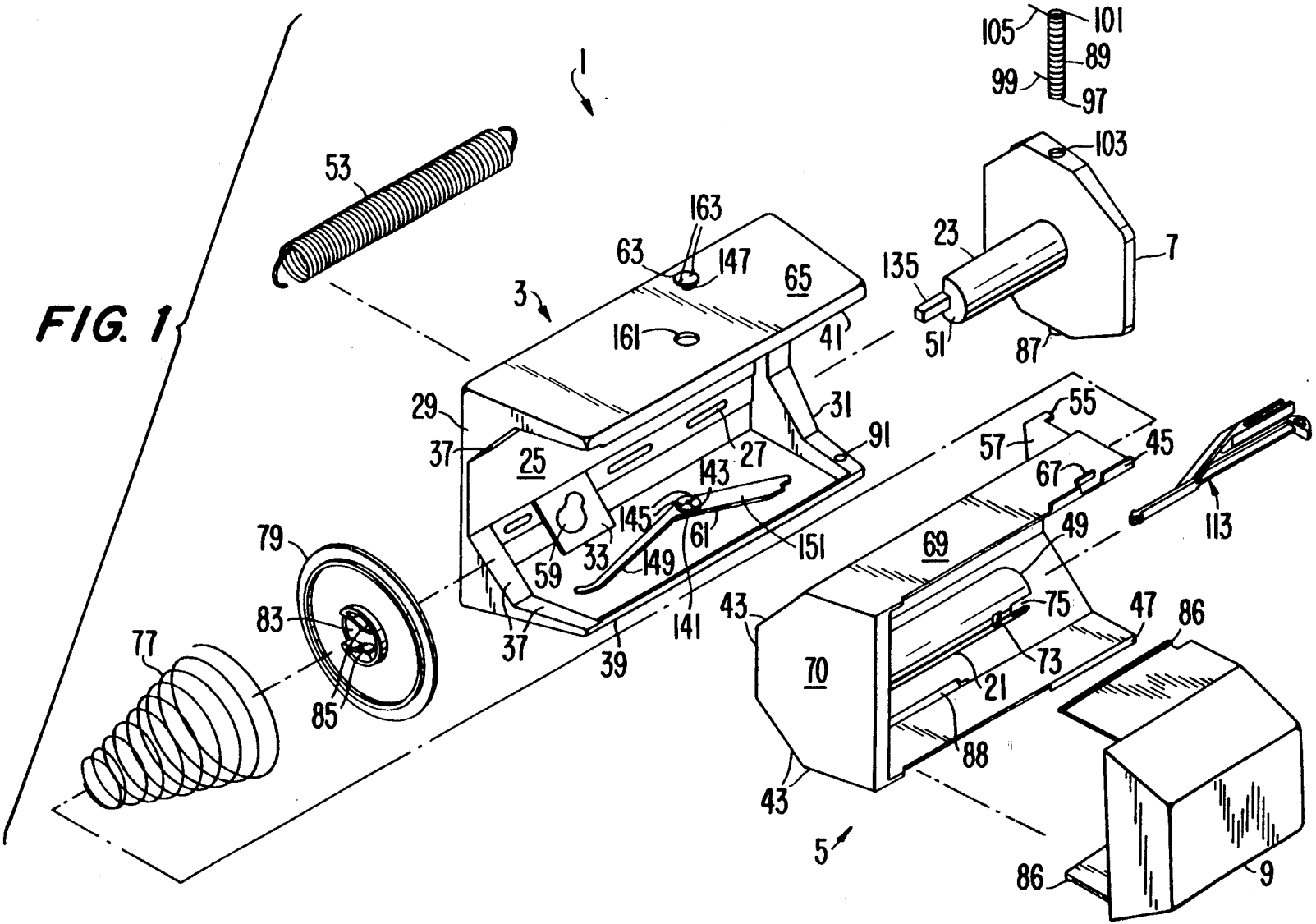
FIG. 1 is an exploded view of a first embodiment of a dispenser according to the present invention.

The drawings illustrate a dispenser, indicated generally by the reference numeral 1, for dispensing flexible sheet material, e.g., toilet tissue, that is wound on dispensing rolls.

Figure 2:
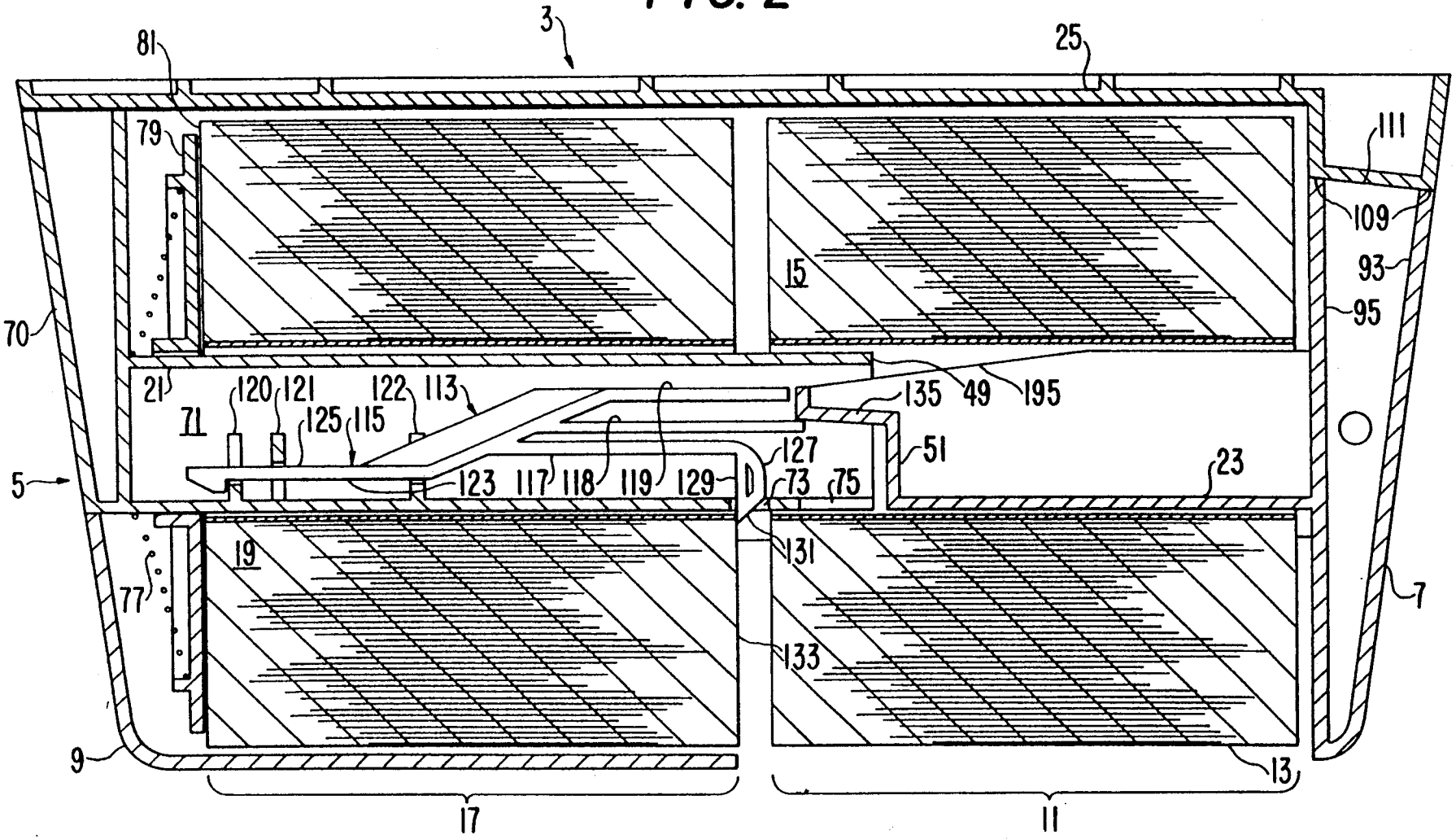
FIG. 2 is a top sectional view of the first embodiment, showing the dispenser with a supply roll and a reserve roll.

In a first embodiment, as pictured in FIGS. 1–10, a dispenser housing is defined by inter-engaging outer frame member 3 and inner frame member 5, a sidewall 7, and a cover 9. As shown in FIG. 2, the housing defines a dispensing section 11 with an open face 13 for dispensing sheet material from a supply roll 15 in a dispensing position, and a storage section 17 for storing a reserve roll 19 of sheet material in a reserve position. A storage mandrel 21 receives and co-axially supports the reserve roll 19 within the storage section 17, while a dispensing mandrel 23 receives and co-axially supports the supply roll 15 within the dispensing section 11.

Referring to FIG. 1, outer frame member 3 has a rear wall 25 which may be mounted to a planar surface, e.g. a wall, by the use of an adhesive, or by screws passed through mounting slots or holes 27 located on rear wall 25. Outer frame member 3 is generally rectangular and open faced, and has generally C-shaped sidewalls 29 and 31 to accommodate, respectively, correspondingly shaped inner frame member 5 and housing sidewall 7. Outer frame member 3 defines a longitudinally extending guideway for passage of inner frame member 5. Specifically, the guideway is defined by guide plate 33, the inner surface of rear wall 25, inner edge surfaces 37 of C-shaped sidewall 29, and upturned lip 39 and downturned lip 41 extending along lower and upper edges of outer frame member 3 defining the open face.

Inner frame member 5 is mounted for sliding along a longitudinal axis of outer frame member 3 within the guideway. Inner frame member 5 has guide surfaces 43 which correspond to the shape of the guideway, interrupted upper guide element 45, and lower guide element 47. During the sliding motion of inner frame member 5, upper and lower guide elements 45, 47 ride against downturned and upturned lips 41, 39, respectively and the guide surfaces 43 slide against edge surfaces 37 and rear wall 25. The lower angled guide surface 43 also slides against guide plate 33.

Figure 7:
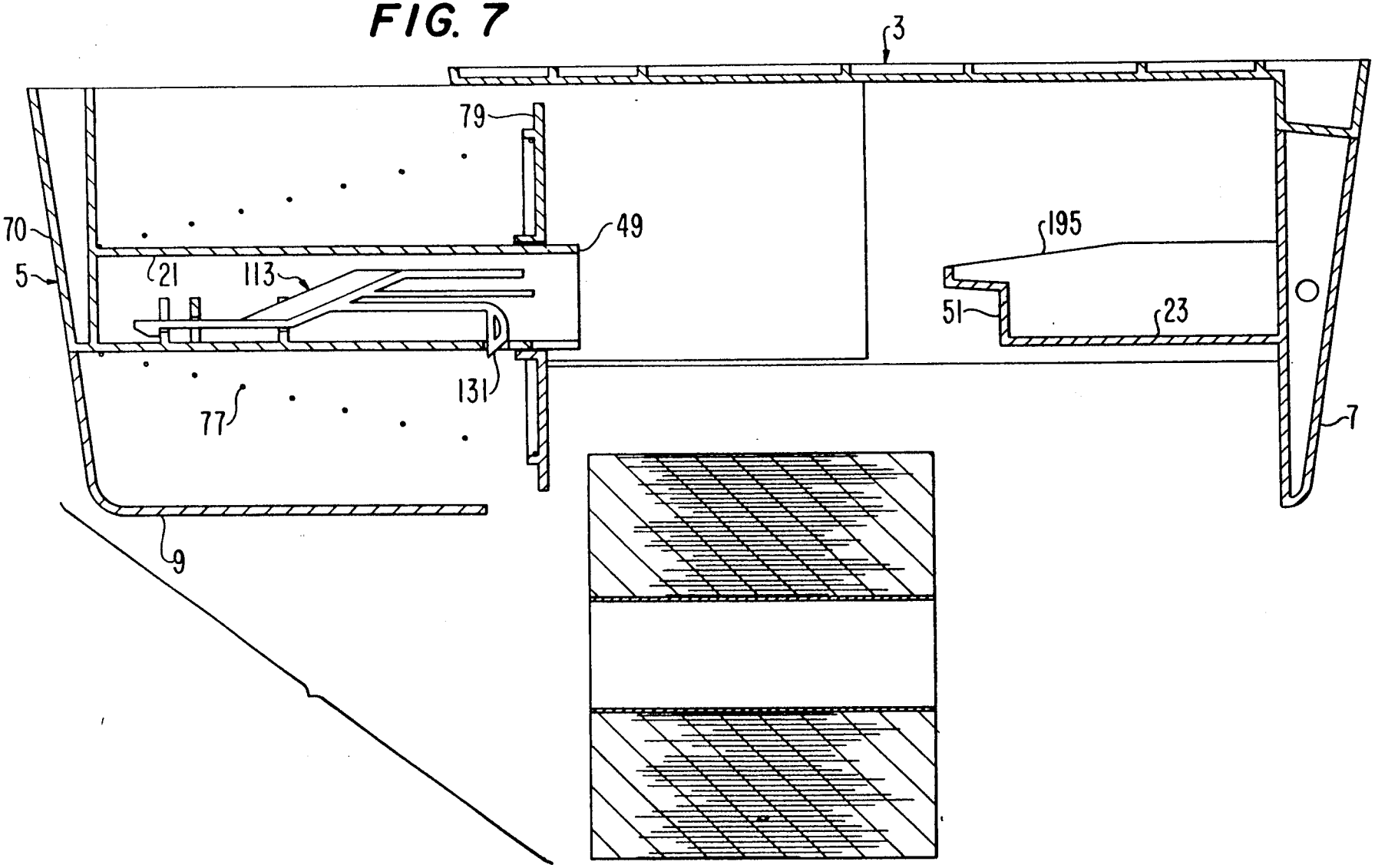
FIG. 7 is a top sectional view of the first embodiment, showing the dispenser after the inner frame has been moved to permit the loading of replacement rolls onto the mandrels.

Inner frame member 5 is movable between a first nested position wherein dispensing and roll transfer can occur, as pictured in FIGS. 2–6, and a second protruded position wherein reloading can occur, as pictured in FIG. 7. In the first nested position, inner frame member 5 is substantially nested within outer frame member 3 and respective free end portions 49, 51 of the storage and dispensing mandrels 21, 23 are normally adjacent one another. In the second protruded position, inner frame member 5 extends outwardly from outer frame member 3 and respective end portions 49, 51 of the storage and dispensing mandrels 21, 23 are spaced from each other a sufficient distance to allow reloading of replacement rolls onto dispensing and storage mandrels 21, 23.

A tension spring 53 is located in a triangular gap formed between upper angled guide surface 43 of inner frame member 5, and outer frame member 3. Tension spring 53 is connected at one end to a hook 55 on trapezoid shaped member 57 extending from the back of the inner frame member 5 and at its other end to a like hook (not pictured) provided on the upper inside of sidewall 29 adjacent the triangular gap. Tension spring 53 biases inner frame member 5 towards the second protruded position. Motion control grease 59 is applied to guide plate 33 and serves to dampen and slow the sliding motion of inner frame member 5.

A locking mechanism defined by a winged element 61 and a hub element 63, is located on a top wall 65 of outer frame member 3 and prevents inner frame member 5 from moving towards the second protruded position during usage, by releasably contacting a locking bracket 67 provided on the upper surface 69 of inner frame member 5. Locking bracket 67 comprises an upwardly turned plastic tab which is set back from interrupted upper guide element 45 of inner frame 5. Details of the locking mechanism's operation will be provided hereinafter.

Storage mandrel 21 is attached at one end to the inside of sidewall 70 of inner frame member 5. Storage mandrel 21 has an open-ended hollow cylindrical shape defining an axial passageway 71 therethrough. A hole 73 and a slot 75 extend transversely through a front portion of the cylindrical sidewall of mandrel 21, for purposes hereinafter described.

A compression spring 77 concentrically mounted on storage mandrel 21, is attached at one end to the inside of sidewall 70 and at the other end to a push disk 79, also concentrically mounted on storage mandrel 21. Push disk 79 serves to evenly distribute the spring force of compression spring 77 across an end surface 81 of reserve roll 19 mounted on storage mandrel 21. Push disk 79 has a central passageway 83 at its center for slidably receiving storage mandrel 21, whereby the push disk 79 may be mounted on the storage mandrel 21 for coaxial movement therealong. When a reserve roll 19 is loaded onto storage mandrel 21, compression spring 77 biases push disk 79 against end 81 of reserve roll 19 and towards the dispensing section 11 and provides the force for transferring a reserve roll 19 from a position on storage mandrel 21, within the storage section 17, to a position on dispensing mandrel 23, within dispensing section 11. Push disk 79 preferably includes keyed protrusions 85 which fit within longitudinal slots (not pictured) extending along storage mandrel 21 and terminating short of the free end 49 thereof for facilitating a smooth sliding action. The ends of the longitudinal slots provide a stop for push disk 79 near the end 49 of storage mandrel 21, which prevents spring 77 from extending push disk 79 past its desired position as pictured in FIG. 6 and inhibiting the dispensing of the transferred roll by avoiding friction with the end of the transferred roll. However, other means may be used to limit the travel of push disk 79 to produce the same effect.

A cover 9 having clips 86 snaps into corresponding grooves 88 (only one illustrated) located in the inner frame member 5. Cover 9 covers the front portion of inner frame member 5 corresponding to storage section 17, for protecting reserve roll 19 positioned in the storage section 17 from the environment and from vandalism. Cover 9 is preferably made of an at least partially transparent material, e.g., a clear or smoked plastic. Thereby, maintenance personnel can readily determine the presence of a reserve roll without the need to unlock and move inner frame member 5. Alternatively, cover 9 could be made of an opaque material and provided with a viewing slot serving the same purpose.

Dispensing mandrel 23 is fixedly attached at one end to housing sidewall 7. Sidewall 7 is pivotally mounted to outer frame member 3 by a pivot pin 87 protruding from the bottom edge surface of sidewall 7 and by a torsion spring 89 which, together, provide an axis of rotation. Pivot pin 87 rests within pivot hole 91 provided in the inner bottom surface of outer frame member 3. In an assembled position, torsion spring 89 is located substantially between the two inner surfaces 93, 95 (see FIG. 2) of sidewall 7. The lower end 97 of the spring 89 rests on an inner shelf (not pictured) positioned near the bottom of sidewall 7 within the same. Lower leg 99 of spring 89 rests against the inner surface 93 of sidewall 7 to restrain spring lower end 97 against rotation relative to sidewall 7 and thereby produce a biasing action described hereinafter. The upper end 101 of spring 89 extends above hole 103 in the top of sidewall 7 and fits within a recess or the like (not pictured) provided in the inside of top wall 65 of outer frame member 3 directly above hole 91. Adjacent the recess is provided an elongated slot (not pictured) which receives an upper leg 105 of spring 89 to restrain spring upper end 101 against rotation, similar to lower end 97.

Figure 3:
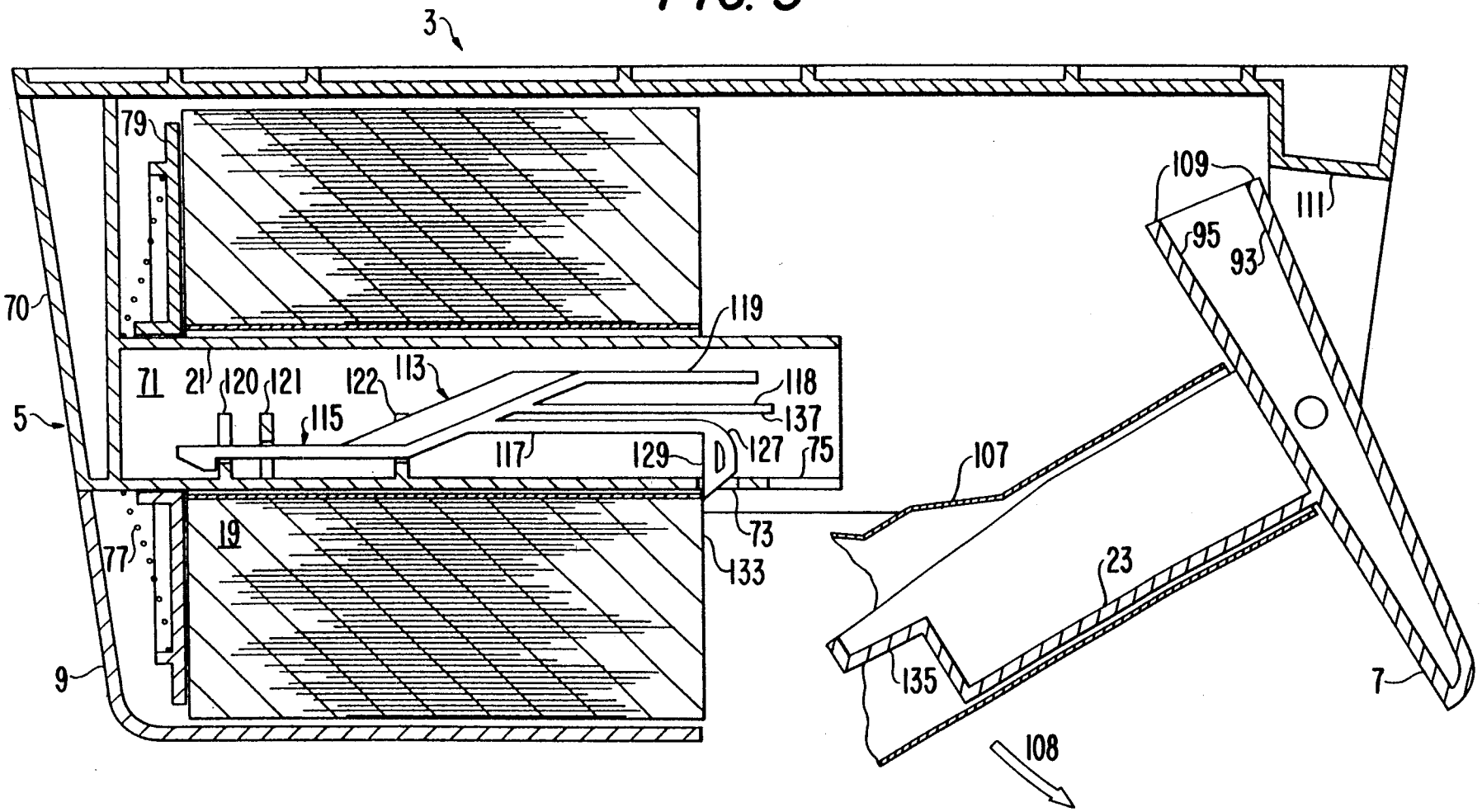
FIG. 3 is a top sectional view of the first embodiment, showing the dispenser after the supply roll has been depleted and the dispensing mandrel has been pivoted to remove the supply roll core.

Sidewall 7 and dispensing mandrel 23 are movable between a first dispensing position for dispensing paper from supply roll 15 positioned in the dispensing section 11, as pictured in FIG. 2, and a second withdrawal position, for user withdrawal of a depleted roll core 107 therefrom, as pictured in FIG. 3. In the dispensing position, dispensing mandrel 23 is located within dispensing section 11 and assumes a substantially co-axial end-to-end relationship with storage mandrel 21. In the withdrawal position, free end portion 51 of dispensing mandrel 23 is pivoted outwardly of said dispensing section 11 to allow removal of a depleted roll core 107, as indicated by arrow 108 in FIG. 3. During this pivotal motion, lower leg 99 is rotated (with sidewall 7) with respect to upper leg 105 to place torsion spring 89 in a stressed position. Upon the release of sidewall 7 (and mandrel 23), lower leg 99 pushes against inner surface 93 to move sidewall 7 to its dispensing position, due to the rotational spring force of spring 89, as indicated by arrow 110 in FIG. 4. Thus, torsion spring 89 has the effect of biasing sidewall 7 and mandrel 23 to the dispensing position. Obviously, other arrangements may be used to provide the biased pivotal motion of sidewall 7 on outer frame member 3.

Pivotal sidewall 7 includes obliquely angled inner edge surfaces 109, and the outer frame member 3 includes a complementary angled mating surface 111 (see FIGS. 2–5). These angled surfaces 109, 111 permit sidewall 7, and dispensing mandrel 23 attached thereto, to pivot freely between the dispensing position and the withdrawal position. Angled inner edge surfaces 109 mate with angled mating surface 111 to stop sidewall 7 at the correct position, i.e., with dispensing mandrel 23 in alignment with storage mandrel 21. Mating surfaces 109 and 111 also provide a flush interface of sidewall 7 and outer frame member 3.

As best shown in FIGS. 2–7, a latch in the form of a spring arm 113 is mounted in axial passageway 71 of storage mandrel 21. Spring arm 113 has a forked configuration including a rear portion 115 and first, second, and third finger elements 117, 118, 119 extending therefrom. Rear portion 115 is clipped into first, second, and third mounting brackets 120, 121, 122 extending transversely into passageway 71 from the inner cylindrical wall surface of storage mandrel 21. First and third mounting brackets 120, 122 provide vertical bearing surfaces for the outer side 123 of rear portion 115 to restrain rear portion 115 from movement in the horizontal plane, while second mounting bracket 121 provides a vertical bearing surface for the inner side 125 of rear portion 115 opposite the surfaces provided by the first and third brackets 120, 122. Each bracket 120, 121, 122 provides a horizontal support surface for rear portion 115. Spring arm 113 is thereby cantilever mounted at one end to storage mandrel 21 within axial passageway 71. As described below, in a rest position, spring arm 113 assumes a position which inhibits the transfer of a reserve roll 19 to a dispensing position (see FIGS. 2–4). Spring arm 113 can be displaced inwardly from its rest position to a position which permits the transfer of reserve roll 19 to the dispensing position to occur (see FIGS. 5 and 6).

First finger element 117 has at its free end, a transversely protruding portion 127 which includes a roll holding surface 129 and a cam surface 131. As can best be seen in FIGS. 2 and 3, in the rest position of spring arm 113, roll holding surface 129 extends through hole 73 and protrudes transversely from storage mandrel 21. Roll holding surface 129 contacts and holds an end surface 133 of reserve roll 19 against the bias of compression spring 77 in its compressed state, and permits the free rotation of supply roll 15 on mandrel 23 in the dispensing section 11. Cam surface 131 assists with the loading of a reserve roll onto the storage mandrel 21, as described hereinafter.

Once supply roll 15 has been exhausted, the user can pivot the dispensing mandrel 23 into the unloading position by rotating dispensing mandrel 23 and sidewall 7, as pictured in FIG. 3. This pivoting buckles the core 107 of the exhausted supply roll 15 at the point of overlap between dispensing mandrel 23 and storage mandrel 21. Core 107 may now be removed from the dispensing mandrel 23. Advantageously, this arrangement allows easy removal of the depleted roll core without requiring a separate manual tearing operation.

After removal of buckled core 107, dispensing mandrel 23 can be released by the user and torsion spring 89 will automatically move dispensing mandrel 23 back to the dispensing position coaxial with the storage mandrel 21. During the pivotal return motion of dispensing mandrel 23, a reduced size end portion 135 of dispensing mandrel 23 will move through slot 75 provided in storage mandrel 21 whereby a contact surface of end portion 135 will engage an abutting surface 137 on second finger element 118 of spring arm 113, as pictured in FIG. 4. The continued motion of end portion 135 deflects second finger element 118 into third element 119 acting as a bracing member. Further continued motion of end portion 135 displaces entire spring arm 113 about mounting point 139 such that roll holding surface 129 is moved inwardly from its protruded position to within axial passageway 71, as pictured in FIG. 5. At this point, roll holding surface 129 no longer inhibits the motion of reserve roll 19 and roll transfer can occur under the force of spring 77, as indicated by arrows 140 in FIG. 5. Once the roll transfer has taken place, dispensing mandrel 23 and sidewall 7 are held in the dispensing position due to (1) the bias of torsion spring 89 and (2) the overlap of dispensing mandrel 23 and the dispensing roll thereon with storage mandrel 21.

Obviously, various latch arrangements may be utilized to retain reserve roll 19 in storage section 17 and effect a roll transfer upon return of dispensing mandrel 23 to the dispensing position. However, the disclosed three finger spring arm 113, and its location within storage mandrel 21, is particularly advantageous. For example, the possibility of accidental trip is minimized because the second and third finger elements 118, 119 are inaccessible while a roll is on the dispensing mandrel 23, and reduced sized end portion 135 contacts the back of second finger element 118 to help keep arm 113 in its rest position. The provision of flexible second finger element 118 permits unimpeded outward displacement of dispensing mandrel 23 (see FIGS. 2 and 3), while providing contact surface 137 for causing deflection of the entire free end of the spring arm 113 when dispensing mandrel 23 returns to the dispensing position.

The function of cam surface 131 is now described. During the loading of a reserve roll onto storage mandrel 21, push disk 79 and reserve roll 19 will travel over cam surface 131 and elastically displace protruding portion 127 and roll holding surface 129 thereof into the axial passageway 71 of storage mandrel 21. When the entire reserve roll is pushed onto storage mandrel 21 beyond hole 73, the core of the reserve roll no longer blocks hole 73, and spring arm 113 is allowed to return to its rest position with protruding portion 127 extending out of the hole 73 and roll holding surface 129 positioned to maintain the reserve roll 19 in its position against the bias of spring 77.

As previously stated, a locking mechanism is defined by a hub element 63 and a winged element 61. Winged element 61 includes a circular mid portion 141 having a central hole 143 and two radial slots 145. Hub elements 63 includes a bottom stem 147 which snaps into central hole 143 of winged element 61 such that hub element 63 is rotatable with respect thereto. Winged element 61 also includes a flexing wing portion 149 and a holding wing portion 151 separated in the horizontal plane by an angle of approximately 160° in order to form a "boomerang-like" shape. The flexing wing portion 149 is relatively flexible for a purpose to be described hereinafter.

Figure 8:
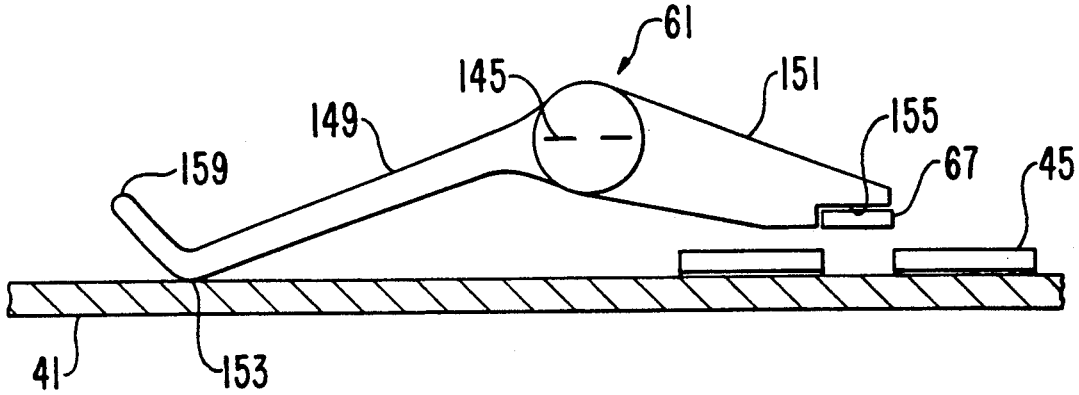
FIGS. 8–10 are top schematic views of the locking mechanism in locked, opening, and fully open positions, respectively.
Figure 9:
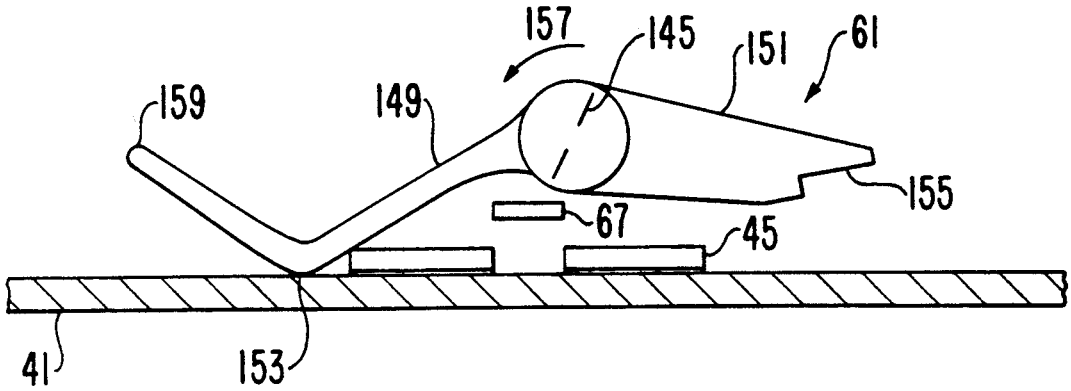
Figure 10:
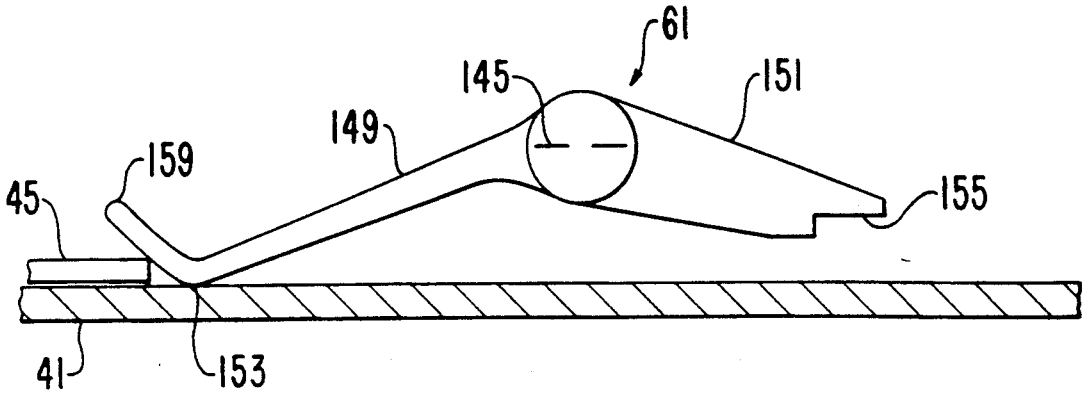

In a locked position as shown in FIG. 8, wing portions 149, 151 extend forwardly to a position adjacent the inside of downturned lip 41, with a surface 153 of flexing wing portion 149 contacting downturned lip 41. In this locked position, a notch 155 in holding wing portion 151 acts as a holding surface which engages locking bracket 67 to prevent movement of inner frame member 5 from the nested position to the protruded position. To release the locking mechanism (see FIG. 9), winged element 61 is rotated counterclockwise as indicated by arrow 157 increasing the force applied by surface 153 of flexing wing portion 149 against the inside of downturned lip 41. Continued rotational force flexes flexing wing portion 149 inwardly and rotates holding wing portion 151 away from downturned lip 41 and locking bracket 67, and toward the rear wall 25 of the outer frame member 3. When this occurs, locking bracket 67 is freed and inner frame member 5 can move toward to its protruded position under the biasing of tension spring 53. During this opening, locking bracket 67 and interrupted upper guide element 45 pass between surface 153 of flexing wing portion 149 and downturned lip 41 and provide contact surfaces to frictionally and torsionally dampen the spring biased motion of inner frame member 5. FIG. 10 shows the locking mechanism in the fully open position with upper guide element 45 to the left of flexing wing portion 149. End 159 of flexing wing portion 149 is curved inwardly away from downturned lip 41 in order to provide a surface for locking bracket 67 to slide against to permit inner frame member 5 to be moved from its protruded position (FIG. 10) to its nested position (FIG. 8).

Hub element 63 performs two important functions. First, hub element 63 pivotally retains winged element 61 on top wall 65. In assembly, winged element 61 is placed against the inside surface of top wall 65, with its circular mid portion 141 extended through hole 161. Then, hub element 63 is engaged with hole 161 and snapped into hole 143 of winged element 61.

Hub element 63 serves also to prevent the locking mechanism from being opened or damaged by non-authorized personnel, i.e., as an anti-pilferage device. To release the locking mechanism, one must first rotate hub element 63 with a special shaped key which fits into slot shaped keyholes 163. Hub element 63 is rotated until keyholes 163 are aligned with keyholes 145 located in winged element 61. Once the keyholes 163, 145 of the hub element 63 and winged element 61 are aligned, the key can slide into the keyholes 145 of winged element 61 and rotate the winged element 61.

Those of ordinary skill in the art will recognize that numerous other locking arrangements may be utilized for releasably retaining inner frame member 5 in its nested position.

Figure 11:
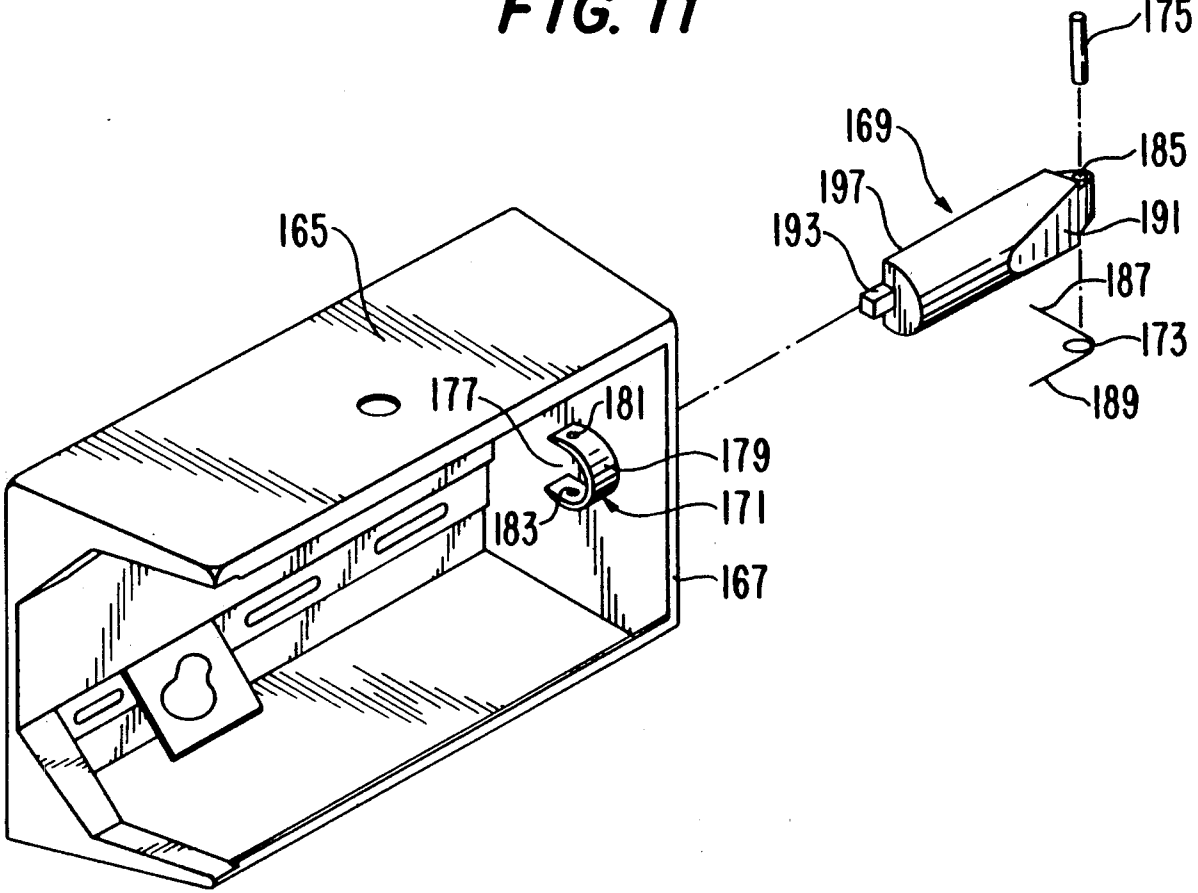
FIG. 11 is a partial exploded view of a second embodiment of a dispenser according to the present invention, illustrating the different features of the second embodiment.

A second embodiment of the invention is now described. The second embodiment, as pictured in FIG. 11, differs from the first embodiment primarily in that outer frame member 165 has sidewall 167 affixed thereto, and dispensing mandrel 169 is pivotally attached to fixed sidewall 167. As in the first embodiment, dispensing mandrel 169 is movable between a first dispensing position coaxial with the storage mandrel, and a second withdrawal position for removing a depleted roll core.

To provide biased pivotal motion for the dispensing mandrel 169, the second embodiment includes a split-ring 171, preferably integrally molded with fixed sidewall 167, a torsion spring 173, and a pivot pin 175. Split-ring 171 is the same diameter as dispensing mandrel 169 to fit within the interior of a supply roll core, and includes an open back portion 177, a front portion 179 opposite the back portion, and upper and lower aligned holes 181, 183. Pivot pin 175 extends through upper hole 181, a hole 185 in dispensing mandrel 169, the center of torsion spring 173, and into lower hole 183 to provide the rotational axis for dispensing mandrel 169. Once pin 175 is positioned as described, upper hole 181 can be mechanically deformed to hold pin 175 in position.

Torsion spring 173 includes a first leg 187 which extends through open back portion 177 and rests against sidewall 167, and a second leg 189 which extends into dispensing mandrel 169. Thereby, dispensing mandrel 169 is biased towards the dispensing position in a manner similar to the way spring 89 biases sidewall 7 of the first embodiment. Hooks (not pictured) or like securing means can be provided on the inside of mandrel 169 and/or sidewall 167 to add stability and restrain displacement of legs 189, 187.

Dispensing mandrel 169 includes a tapered surface 191 near its pivot axis in order to permit the desired pivotal motion between the dispensing mandrel 169 and split-ring 171. So configured, from its dispensing position, the dispensing mandrel 169 can be pivoted outwardly approximately 45°–50° until tapered surface 191 abuts the front portion 179 of split-ring 171. A stop (not pictured) may be provided to prevent the dispensing mandrel 169 from moving past a position in alignment with storage mandrel 21 during its spring biased return to the dispensing position.

The provision of split-ring 171 for pivotally mounting dispensing mandrel 169 to sidewall 167 is advantageous in several respects. For example, the positioning of pivot axis (pin 179) away from the wall 167 and within split-ring 171, minimizes the possibility that a user may have his or her finger pinched when the dispensing mandrel 169 is pivoting, because the abutting surfaces 191, 179 are offset from sidewall 167 and located within a roll core 107. The open back portion 177 of split-ring 171 provides a channel which easily receives the dispensing mandrel 169 and facilitates alignment of holes 181, 185, 183 and the deposit therein of pin 175.

Operation of the inventive dispenser is now sequentially described, beginning with the loading operation. To load the dispenser, an authorized service person, e.g., a janitor, unlocks the locking mechanism whereupon inner frame member 5 moves from its nested position, as pictured in FIG. 2, to its protruded position, as pictured in FIG. 7, under the bias of the tension spring 53. Motion control grease 53 and flexing wing portion 149 ensure a smooth and slow sliding action. With the respective free ends of the storage and dispensing mandrels spaced from each other, the service person may load supply roll 15 onto dispensing mandrel 23 (or 169) and reserve roll 19 onto storage mandrel 21. In the latter loading operation, reserve roll 19 is pushed onto storage mandrel 21 against the bias of spring 77, and in the process is pushed over cam surface 131 which deflects first finger element 117 into axial passageway 71 until an entire reserve roll 19 is loaded onto the storage mandrel 21 and the roll holding surface 129 may extend through hole 73 to hold the end surface 133 of the reserve roll 19. Next, the service person returns inner frame member 5 to the first nested position against the bias of spring 53 until locking bracket 67 catches on notch 155 to lock inner frame member 5 in that position. As inner frame member 5 is returned to its nested position, reduced size end portion 135 (or 193) of dispensing mandrel 23 (or 169) enters axial passageway 71 of storage mandrel 21. Dispensing mandrel 23 (or 169) has a rear tapered surface 195 (or 197) to ensure that this insertion can occur without interference. When the nested position has been fully reached, the tip of reduced size end portion 135 (or 193) overlaps slightly with the tip of second finger element 118, on a back side thereof.

One-by-one, users will dispense sheet material from open face 13 and deplete supply roll 15. When the supply roll 15 has been depleted, a user may grasp dispensing mandrel 23 (or 169) and pivot the same outwardly towards the second withdrawal position, as shown in FIG. 3. In the first embodiment, the user rotates dispensing mandrel 23 together with sidewall 7 with respect to the remaining housing structure. In the second embodiment, the user rotates dispensing mandrel 169 with respect to the remaining housing structure, including fixed sidewall 167. This rotation by the user readily buckles the empty core 107 of the supply roll 15 (see FIG. 3). At the same time, the elasticity of second finger portion 118 allows reduced size end portion 135 (or 193) of dispensing mandrel 23 (or 169) to pass thereby without significant resistance. The user then need only remove the buckled roll core 107 and release dispensing mandrel 23 (or 169). The dispenser completes the rest of the roll transfer automatically as described below.

Figure 4:
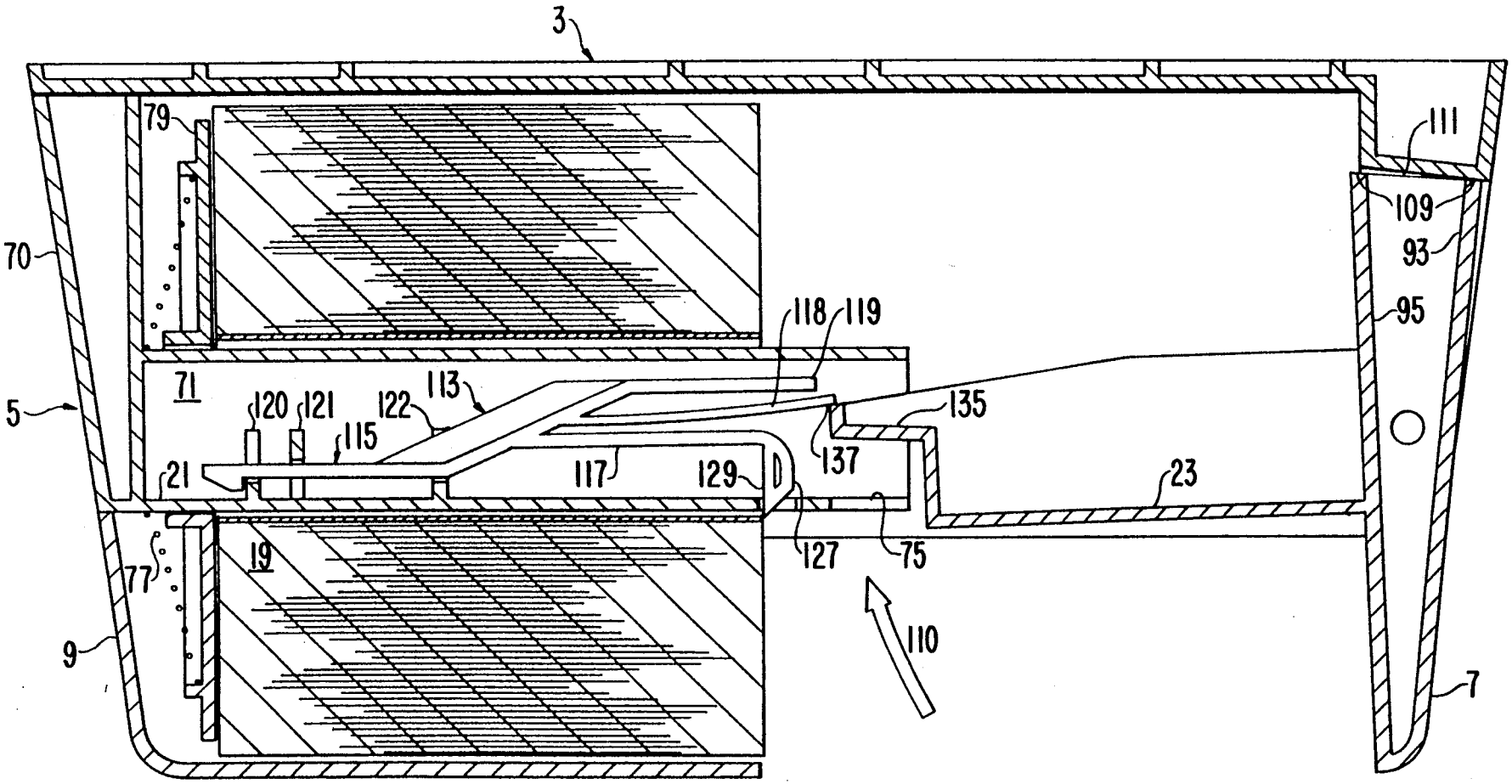
FIG. 4 is a top sectional view of the first embodiment, showing the dispenser after the dispensing mandrel has returned almost to its first position.
Figure 5:
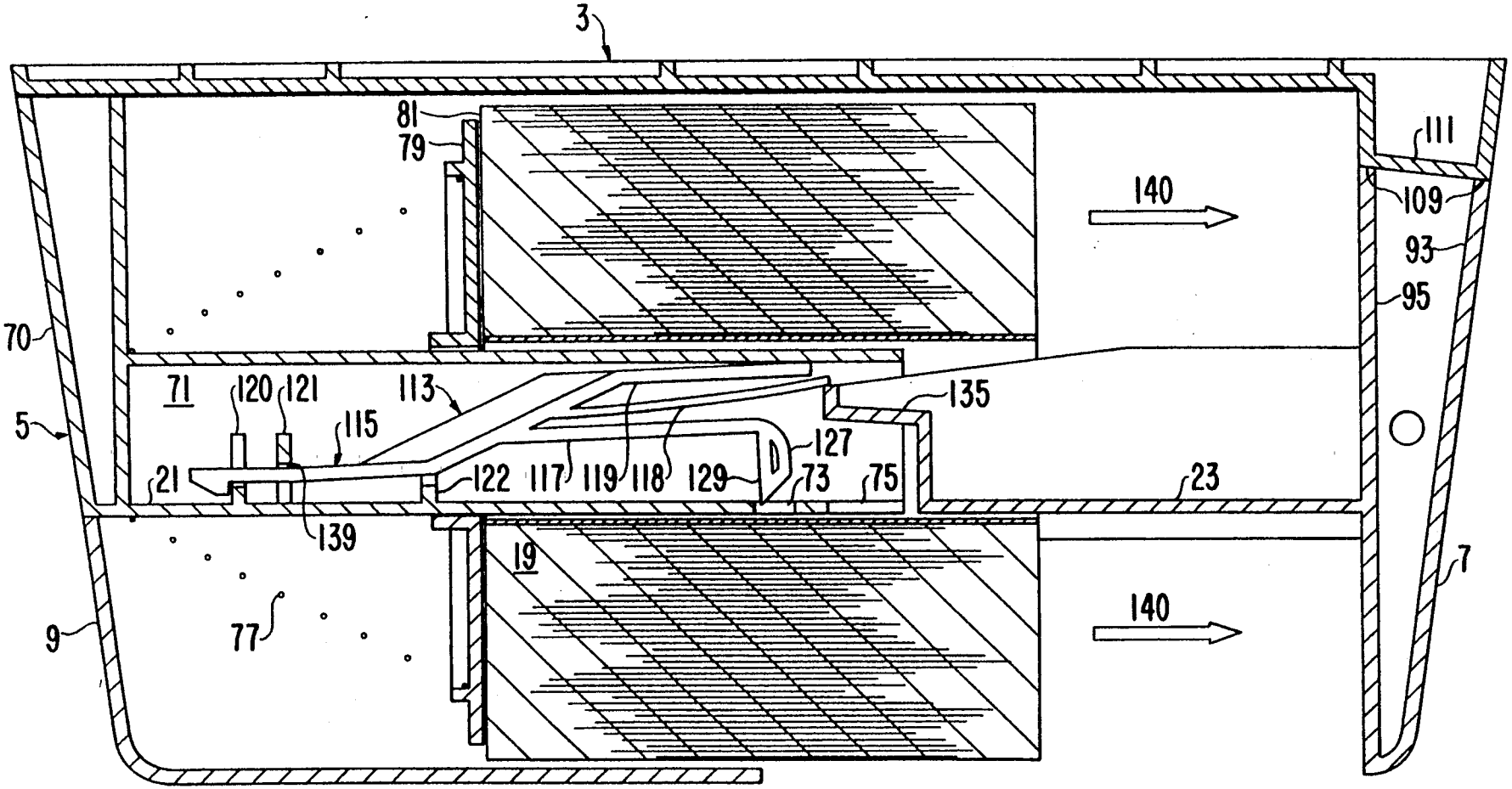
FIG. 5 is a top sectional view of the first embodiment, showing the dispenser as the transfer means is transferring the reserve roll into the dispensing position.
Figure 6:
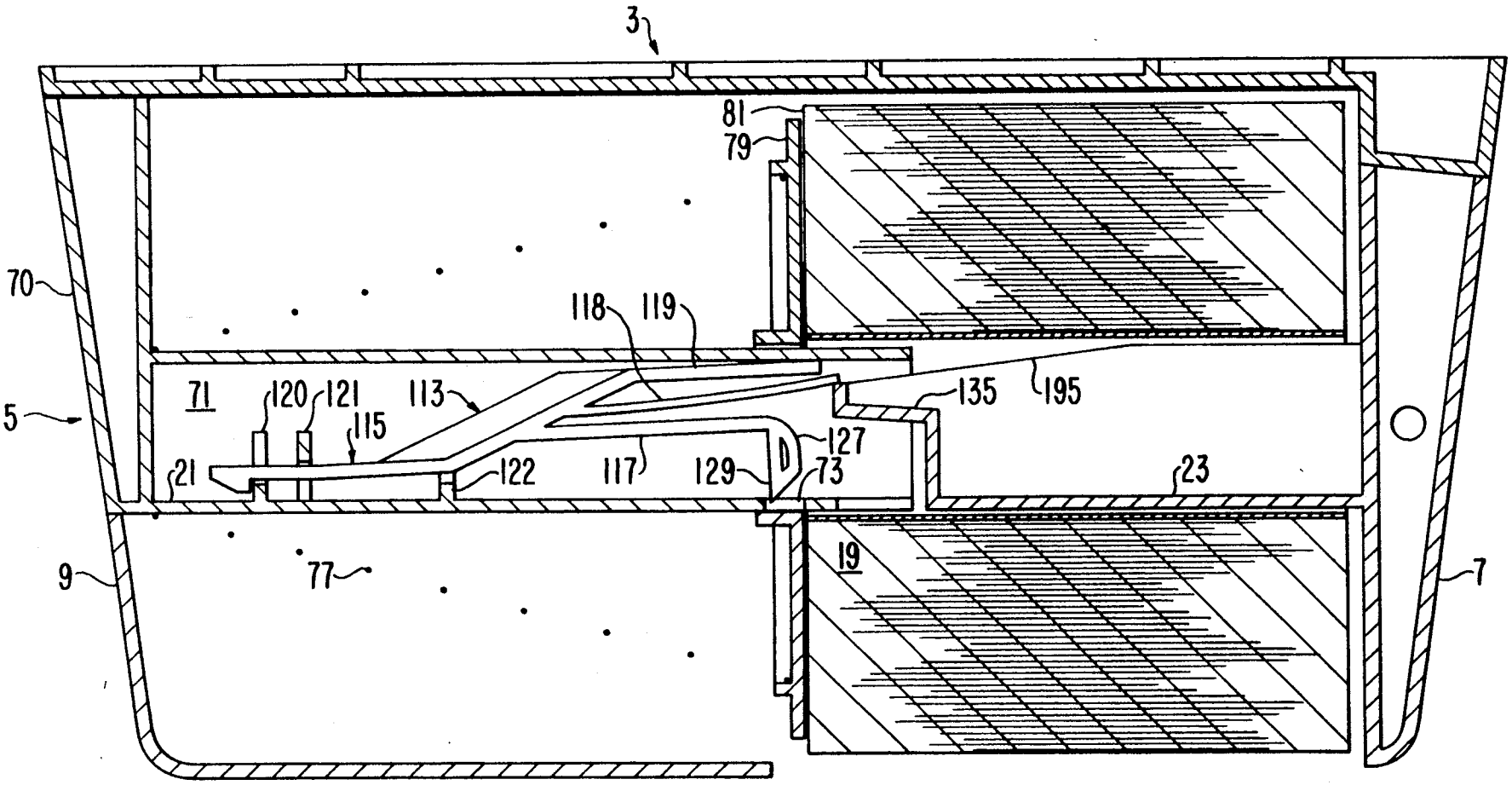
FIG. 6 is a top sectional view of the first embodiment, showing the dispenser after the transfer means has transferred the reserve roll into dispensing position.

Torsion spring 89 (or 173) returns the dispensing mandrel 23 (or 169) to a first dispensing position co-axial with the storage mandrel 21, as illustrated in FIG. 4. In this return motion, reduced size end portion 135 (or 193) of dispensing mandrel 23 (or 169) travels through slot 75 of storage mandrel 21 and contacts an abutting surface 137 of the second finger element 118 opposite the surface against which the tip of reduced size end portion 135 (or 193) rested in the original position pictured in FIG. 2. Second finger element 118 deflects into the third finger element 119. Since third finger element 119 is relatively rigid, the force of second finger element 118 against third finger element 119 causes spring arm 113 to deflect along rear portion 115 a sufficient amount for roll holding surface 129 to be retracted inwardly out of contact with end surface 133 of reserve roll 19.

Once roll holding surface 129 is retracted into axial passageway 71, spring biased push disk 79 pushes reserve roll 19 onto the dispensing mandrel 23 (or 169). As pictured in FIG. 6, reserve roll 19 has reached its dispensing position and is ready to be dispensed.

Maintenance personnel determine whether dispenser replenishment is necessary by looking through the partially transparent cover 9 to see if there is a reserve roll on storage mandrel 21. When necessary, an authorized service person may unlock the locking mechanism, and load a paper roll onto the storage mandrel 21 in the manner previously described. If desired, the remaining portion of the roll in the dispensing section may also be replaced.

The force to transfer a reserve roll 19 to dispensing section 11 is provided by compression spring 77. Therefore, dispenser 1 does not require a vertical mounting orientation to utilize the force of gravity. Preferably, spring 77 generates sufficient force to move reserve roll 19 to the dispensing position regardless of the mounting orientation of the dispenser housing. Thus, the dispenser may be mounted and operated in any orientation including horizontal, inverted horizontal, or vertical.

The component pieces of dispenser 1 may comprise known suitable materials such as plastics and metals, and be formed with conventional manufacturing techniques. Preferably, storage mandrel 21 is integrally molded as one piece with inner frame member 5. In the first embodiment, dispensing mandrel 23 is integrally molded with sidewall 7, apart from one piece molded frame member 3. In the second embodiment, sidewall 167 is integrally molded as part of outer frame member 165, and dispensing mandrel 169 is separately molded as one piece. Preferably, the above-described pieces are formed of rigid plastic, e.g., a thermoplastic, as are cover 9 and push disk 79. It is essential that flexible wing portion 149 of locking element 61 be made of flexible material to provide the required flexing action. Conveniently, element 61 may be molded as one piece of acetal plastic (e.g., DELRIN). Hub element 63 may be molded of the same or a more rigid material. Spring arm 113 preferably also is formed of molded flexible plastic such as DELRIN, but may also be formed of metals, e.g., aluminum, exhibiting the required resiliency characteristics.

The present embodiments illustrate the inner frame member 5 carrying the storage mandrel 21 and the outer frame member 3 (or 165) carrying dispensing mandrel 23 (or 169). However, the mounting of the mandrels on the inner frame member 5 and the outer frame member 3 (or 165) may be reversed.

While particular embodiments of the invention have been shown and described, it is recognized that various modifications thereof will occur to those skilled in the art. Therefore, the scope of the herein-described invention shall be limited solely by the claims appended hereto.

We claim:

1. An apparatus for storing and dispensing a plurality of rolls of flexible sheet material, comprising:

a housing defining a storage section and a dispensing section;

a storage mandrel for receiving and co-axially supporting within said storage section a reserve roll of sheet material;

a dispensing mandrel movable between a first position wherein a supply roll of sheet material may be co-axially rotatably supported within said dispensing section for dispensing material therefrom, and a second position for user withdrawal of a depleted roll core from the dispensing mandrel; and transfer means for automatically transferring a reserve roll from a reserve position on the storage mandrel to a dispensing position on the dispensing mandrel, responsive to said dispensing mandrel substantially arriving at said first position after withdrawal of a depleted roll core.

2. An apparatus according to claim 1, wherein said storage and dispensing mandrels are arranged to assume a substantially co-axial end-to-end relationship with each other when said dispensing mandrel is in said first position, whereby said transfer means automatically moves at least a major portion of a reserve roll off of said storage mandrel and onto said dispensing mandrel responsive to said dispensing mandrel being moved into said first position.

3. An apparatus for storing and dispensing a plurality of rolls of flexible sheet material, comprising:

a housing defining a storage section and a dispensing section;

a storage mandrel for receiving and co-axially supporting within said storage section a reserve roll of sheet material;

a dispensing mandrel movable between a first position wherein a supply roll of sheet material may be co-axially rotatably supported within said dispensing section for dispensing material therefrom, and a section position for user withdrawal of a depleted roll core from the dispensing mandrel; and transfer means for automatically transferring a reserve roll from a reserve position on the storage mandrel to a dispensing position on the dispensing mandrel, responsive to said dispensing mandrel being moved into said first position after withdrawal of a depleted roll core;

wherein said transfer means is operative to move the reserve roll to said dispensing position regardless of the mounting orientation of the housing.

4. An apparatus for storing and dispensing a plurality of rolls of flexible sheet material, comprising:

a housing defining a storage section and a dispensing section;

a storage mandrel for receiving and co-axially supporting within said storage section a reserve roll of sheet material;

a dispensing mandrel movable between a first position wherein a supply roll of sheet material may be co-axially rotatably supported within said dispensing section for dispensing material therefrom, and a second position for user withdrawal of a depleted roll core from the dispensing mandrel; and transfer means for automatically transferring a reserve roll from a reserve position on the storage mandrel to a dispensing position on the dispensing mandrel, responsive to said dispensing mandrel being moved into said first position after withdrawal of a depleted roll core;

wherein said storage and dispensing mandrels are arranged to assume a substantially co-axial end-to-end relationship with each other when said dispensing mandrel is in said first position, whereby said transfer means automatically moves at least a major portion of a reserve roll off of said storage mandrel and onto said dispensing mandrel responsive to said dispensing mandrel being moved into said first position;

wherein said transfer means comprises:

bias means for biasing a reserve roll on said storage mandrel towards said dispensing mandrel, and moving the reserve roll to said dispensing position;

retention means for releasably retaining said reserve roll on said storage mandrel; and release means for releasing said retaining means, and thereby allowing said reserve roll to be moved by said bias means to said dispensing position, responsive to said dispensing mandrel being moved into said first position.

5. An apparatus according to claim 4, wherein:

said dispensing mandrel is pivotal between said first and second positions;

said retention means comprises a latch mounted on said storage mandrel, said latch having a roll holding surface arranged to releasably contact a first end surface of a reserve roll supported by said storage mandrel; and said release means comprises a contact surface on said dispensing mandrel that contacts said latch to remove the roll holding surface from contact with said reserve roll end surface when said dispensing mandrel is pivoted into said first position, whereby the reserve roll may be moved to the dispensing position under the urging of said bias means.

6. An apparatus according to claim 5, wherein said bias means comprises a compression spring arranged to be urged against a second end surface of said reserve roll opposite said first end surface.

7. An apparatus according to claim 6, wherein said compression spring generates sufficient force to move a reserve roll from the storage position to the dispensing position regardless of the mounting orientation of the housing.

8. An apparatus according to claim 6, wherein said bias means further comprises a push disk attached to said spring for evenly distributing spring force across said second end surface of the reserve roll, said spring and push disk being mounted co-axially on said storage mandrel.

9. An apparatus according to claim 5, wherein said latch comprises a resilient spring-arm displaceable from a rest position by said contact surface contacting an abutting surface on a first end of the spring-arm as said dispensing mandrel pivots into said first position.

10. An apparatus according to claim 9, wherein the spring arm is cantilevered at a second end opposite said first end, to said storage mandrel within an axial passageway thereof.

11. An apparatus according to claim 10, wherein said roll holding surface is provided on a portion of said first end of said spring arm protruding transversely from said passageway.

12. An apparatus according to claim 11, wherein said spring arm comprises first and second finger elements, said abutting surface being provided on a free end of said second finger element and said roll holding surface being provided on a free end of said first finger element.

13. An apparatus according to claim 12, wherein said spring arm further comprises a third finger element acting as a relatively rigid bracing member into which said second finger element flexes when contacted by said contact surface as said dispensing mandrel pivots into said first position.

14. An apparatus according to claim 11, wherein said portion of said first end further has a cam surface for elastically displacing the portion of said first end inwardly when a reserve roll is loaded onto the storage mandrel.

15. An apparatus according to claim 10, wherein said abutting surface is located in said axial passageway, and said contact surface is provided on an end portion of said dispensing mandrel that pivots transversely through a slot in said storage mandrel, into said axial passageway, and into contact with said abutting surface, as said dispensing mandrel pivots into said first position.

16. An apparatus according to claim 5, wherein said dispensing mandrel is pivotally attached at one end to a fixed sidewall of said housing.

17. An apparatus according to claim 5, wherein said housing comprises a sidewall pivotable with respect to the remaining housing structure, and said dispensing mandrel is fixedly attached at one end to said sidewall for pivotal motion therewith.

18. An apparatus according to claim 5, wherein said dispensing mandrel is spring-biased toward said first position.

19. An apparatus for storing and dispensing a plurality of rolls of flexible sheet material, comprising:

a housing defining a storage section and a dispensing section, said housing having inter-engaging inner and outer frame members;

a storage mandrel for receiving and co-axially supporting within said storage section a reserve roll of sheet material, said storage mandrel being attached at one end to a sidewall of one of said inner and outer frame members, said storage mandrel having a longitudinal axis;

a dispensing mandrel for receiving and coaxially rotatably supporting within said dispensing section a supply roll of sheet material from which material may be dispensed, said dispensing mandrel being attached at one end to a sidewall of the other one of said inner and outer frame members; and a transfer mechanism for transferring a reserve roll from a reserve position on the storage mandrel to a dispensing position on the dispensing mandrel following removal of a depleted roll core from the dispensing mandrel;

wherein said inner frame member is movable relative to said outer frame member in the direction of said longitudinal axis from:

a first position wherein respective end portions of the storage and dispensing mandrels are adjacent one another so as to permit operation of said transfer mechanism; and a second position wherein said respective end portions are spaced from each other allowing replacement rolls to be loaded onto said storage and dispensing mandrels.

20. An apparatus for storing and dispensing a plurality of rolls of flexible sheet material, comprising:

a housing defining a storage section and a dispensing section, said housing having inter-engaging inner and outer frame members;

a storage mandrel for receiving and co-axially supporting within said storage section a reserve roll of sheet material, said storage mandrel being attached at one end to a sidewall of one of said inner and outer frame members;

a dispensing mandrel for receiving and coaxially rotatably supporting within said dispensing section a supply roll of sheet material from which material may be dispensed, said dispensing mandrel being attached at one end to a sidewall of the other one of said inner and outer frame members; and a transfer mechanism for transferring a reserve roll from a reserve position on the storage mandrel to a dispensing position on the dispensing mandrel following removal of a depleted roll core from the dispensing mandrel;

wherein said inner frame member is movable relative to said outer frame member from:

a first position wherein respective end portions of the storage and dispensing mandrels are adjacent one another so as to permit operation of said transfer mechanism; and a second position wherein said respective end portions are spaced from each other allowing replacement rolls to be loaded onto said storage and dispensing mandrels; and wherein said inner frame member is movable along a longitudinal axis of said housing in a guideway defined by said outer frame member, is at least partially nested within said outer frame member in said first position, and extends outwardly from said outer frame member in said second position.

21. An apparatus according to claim 20, wherein said outer frame member has an open face to allow user access to a supply roll on the dispensing mandrel, and said inner frame member has a cover attached thereto for protecting a reserve roll on the storage mandrel.

22. An apparatus according to claim 21, wherein said cover is at least partially transparent to allow visual inspection of the storage section.

23. An apparatus according to claim 20, wherein said guideway comprises:

a passageway provided through a sidewall of the outer frame member, corresponding in shape to the inner frame member; and at least one lip extending along an outer edge of said outer frame member.

24. An apparatus according to claim 23, further comprising bias means for biasing said inner frame member toward said second position, and holding means for selectively holding said inner frame member in said first position against said bias, said holding means being releasable, whereby said bias means can move said inner frame member to said second position.

25. An apparatus according to claim 24, wherein said bias means comprises a tension spring attached at opposite ends to said inner and outer frame members.

26. An apparatus according to claim 24, further comprising dampening means for dampening the movement of said inner frame member relative to said outer frame member.

27. An apparatus according to claim 26, wherein said dampening means comprises a motion control grease applied to at least one of slideably engaging surfaces of said inner and outer frame members.

28. An apparatus according to claim 26, wherein said dampening means comprises a flexible member on one of said inner and outer frame members, and a contact member on said other of said inner or outer frame member, and whereby during the motion of said inner frame member from said first position to said second position, said contact member engages and deflects said flexible member to dampen the movement of said inner frame member relative to said outer frame member.

29. An apparatus according to claim 24, wherein said holding means comprises a locking member having a holding surface on one of said inner or outer frame members, and an engaging member on said other of said inner or outer frame member, such that said locking member may be moved between a locked position whereby said holding surface engages said engaging member to prevent motion of said inner frame member from its first position to its second position, and an unlocked position whereby said holding surface no longer contacts said engaging member and motion of said inner frame member with respect to said outer frame member is no longer prevented.

30. An apparatus according to claim 29, wherein said locking member includes a flexible portion located on a portion of the locking member opposite said holding surface, and wherein said flexible portion deflects to permit said locking member to be moved from said locked position to said unlocked position.

31. An apparatus for storing and dispensing a plurality of rolls of flexible sheet material, comprising:

a housing defining a storage section and a dispensing section, said housing having inter-engaging inner and outer frame members;

a storage mandrel for receiving and co-axially supporting within said storage section a reserve roll of sheet material, said storage mandrel being attached at one end to a sidewall of one of said inner and outer frame members;

a dispensing mandrel for receiving and coaxially rotatably supporting within said dispensing section a supply roll of sheet material from which material may be dispensed, said dispensing mandrel being attached at one end to a sidewall of the other one of said inner and outer frame members; and a transfer mechanism for transferring a reserve roll from a reserve position on the storage mandrel to a dispensing position on the dispensing mandrel following removal of a depleted roll core from the dispensing mandrel;

wherein said inner frame member is movable relative to said outer frame member from:

a first position wherein respective end portions of the storage and dispensing mandrels are adjacent one another so as to permit operation of said transfer mechanism; and a second position wherein said respective end portions are spaced from each other allowing replacement rolls to be loaded onto said storage and dispensing mandrels; and wherein said dispensing mandrel is pivotally mounted to said other frame member for pivotal movement between a first position within said dispensing section and a second position wherein said end portion of said dispensing mandrel extends outwardly of said dispensing section allowing removal of a depleted roll core.

32. An apparatus according to claim 31, wherein said other frame member comprises a sidewall pivotable with respect to the remaining housing structure, and said dispensing mandrel is fixedly attached at one end to said side wall for pivotal motion therewith.

33. An apparatus according to claim 31, wherein said dispensing mandrel is pivotally attached at one end to a fixed sidewall of said other frame member.

34. An apparatus according to claim 31, wherein said transfer mechanism is operative to automatically transfer a reserve roll on said storage mandrel to the dispensing mandrel upon return of the dispensing mandrel to said first position following removal of a depleted roll core.

35. An apparatus according to claim 34, wherein said transfer means comprises:

bias means for biasing a reserve roll on said storage mandrel towards said dispensing mandrel and selectively moving the reserve roll to said dispensing position;

retention means for releasably retaining said reserve roll on said storage mandrel; and release means for releasing said retaining means, and thereby allowing said reserve roll to be moved by said bias means to said dispensing position, responsive to said dispensing mandrel being moved into said first position.

36. An apparatus according to claim 35, wherein:

said retention means comprises a latch mounted on said storage mandrel, having a roll holding surface arranged to releasably contact a first end surface of a reserve roll supported by said storage mandrel; and said release means comprises a contact surface on said dispensing mandrel that contacts said latch to remove the roll holding surface from contact with said reserve roll end surface when said dispensing mandrel is pivoted into said first position, whereby the reserve roll may be moved to the dispensing position under the urging of said bias means.

37. An apparatus for storing and dispensing a plurality of rolls of flexible sheet material, comprising:

a housing defining a storage section and a dispensing section;

a storage mandrel for receiving and co-axially supporting within said storage section a reserve roll of sheet material;

a dispensing mandrel movable between a first position wherein a supply roll of sheet material may be co-axially rotatably supported within said dispensing section for dispensing material therefrom, and a second position for user withdrawal of a depleted roll core from the dispensing mandrel; and transfer means for automatically transferring a reserve roll from a reserve position on the storage mandrel to a dispensing position on the dispensing mandrel, responsive to said dispensing mandrel being moved into said first position after withdrawal of a depleted roll core;

wherein said storage and dispensing mandrels are arranged to assume a substantially co-axial end-to-end relationship with each other when said dispensing mandrel is in said first position, and said storage and dispensing mandrels are arranged to be angularly displaced from each other when said dispensing mandrel is in said second position, and whereby said transfer means automatically moves at least a major portion of a reserve roll off of said storage mandrel and onto said dispensing mandrel responsive to said dispensing mandrel being moved into said first position.

* * * * *